United States Patent [19]

Wilson

[11] Patent Number: 4,765,774

[45] Date of Patent: Aug. 23, 1988

[54] APPARATUS FOR REDISTRIBUTING ASPHALT

[76] Inventor: Louie Wilson, 655 Georgia Ave., Fayetteville, Ga. 30214

[21] Appl. No.: 858,116

[22] Filed: May 1, 1986

[51] Int. Cl.[4] ..... E01C 19/20; E01C 19/42

[52] U.S. Cl. ..... 404/101; 404/127

[58] Field of Search ..... 404/101, 106, 107, 126, 404/127

[56] References Cited

U.S. PATENT DOCUMENTS 3,020,812 2/1962 Gross ..... 404/107

4,557,626 12/1985 McKay et al. ..... 404/122 X

*Primary Examiner*—George A. Suchfield

*Attorney, Agent, or Firm*—Thomas & Kennedy

[57] ABSTRACT

Apparatus is adapted to be attached adjacent the rear of an asphalt spreader for redistributing asphalt from an adjacent lane beside the spreader onto the lane being surfaced behind the spreader. The apparatus comprises a mount, a motor mounted to the mount and a brush coupled by power transmission means with the motor for rotatable movement. The mount may be pivoted between an operative position with the brush located on an adjacent lane and an elevated, stowed position behind the spreader.

10 Claims, 2 Drawing Sheets

APPARATUS FOR REDISTRIBUTING ASPHALT

TECHNICAL FIELD

This invention relates generally to asphalt spreaders and particularly to apparatuses adapted to be attached to asphalt spreaders for asphalt redistribution.

BACKGROUND OF THE INVENTION

Machines, such as that exemplified in U.S. Pat. No. 3,359,875, are today employed in paving and resurfacing roads. Where a road lane is to be paved with asphalt an asphalt spreader is used to spread a layer of asphalt evenly along the entire width of the lane as the machine advances. After the asphalt has been laid it is rolled with a mechanized roller and the asphalt then allowed to set.

As it is not feasible to lay the entire width of multilane roads with one pass of a spreader, asphalt is normally laid by a spreader along one lane at a time. When a second lane is later laid adjacent to the first lane, a small strip of asphalt is applied overlying a side portion of the previously surfaced lane in order that surface continuity may be ensured. After this is done a crew of sweepers will typically be employed to sweep the excess asphalt that overlies the side of the previously surfaced lane onto the freshly laid asphalt behind the spreader in advance of the roller. Asphalt that has been swept from the previously surfaced lane is then rolled mixed in with that spread directly from the spreader.

The just described procedure has produced the desired results but at the expense of the use of substantial labor. The use of mechanized sweepers, such as that shown in U.S. Pat. No. 3,825,968, which have been employed with vehicles such as gutter sweepers, are not viable alternatives to manual labor since they tend to fling sweep material omnidirectionally.

Accordingly, the present invention is directed to the provision of apparatus for redistributing asphalt spread by an asphalt spreader off of an adjacent lane and onto a lane being surfaced by the spreader.

SUMMARY OF THE INVENTION

In one form of the invention apparatus for redistributing asphalt laid by an asphalt spreader overlapping an lane adjacent a lane being surfaced by the spreader comprises a mount, motor means mounted to the mount and a brush coupled with the motor for rotatable movement. The apparatus also comprises means for securing the mount to the rear of an asphalt spreader with the brush located at a position for sweeping asphalt from the adjacent lane onto the lane being surfaced to the rear of the spreader.

In another form of the invention apparatus is adapted to be attached to the rear of an asphalt spreader to sweep asphalt from a lane beside the spreader onto a lane being surfaced behind the spreader as it moves in a direction of travel. The apparatus comprises a mount, a motor mounted to the mount, and a brush coupled by power transmission means with the motor for rotatable movement about an axis. The apparatus further comprises means for securing the mount to the rear of the asphalt spreader with the axis oriented generally parallel with the direction of spreader travel.

In yet another form of the invention apparatus for redistributing asphalt spread by an asphalt spreader comprises a mount adapted to be pivotably secured to the rear of an asphalt spreader for pivotal movement about a pivot axis extending generally fore and aft of the spreader. The mount includes a translation table slidably supported upon a track which extends transversely to the pivot axis. A motor is secured to the translation table which has a motor drive shaft extending generally parallel with the track into a right angle gear box. A brush drive shaft to which a brush is secured is coupled with the motor drive shaft within the gear box so as to extend generally parallel with the pivot axis. A support roller is rotatably mounted to the mount. A handle is pivotably mounted to the mount and coupled with the translation table by which the position of the brush relative to the mount may be adjusted.

DETAILED DESCRIPTION

Figure 1:
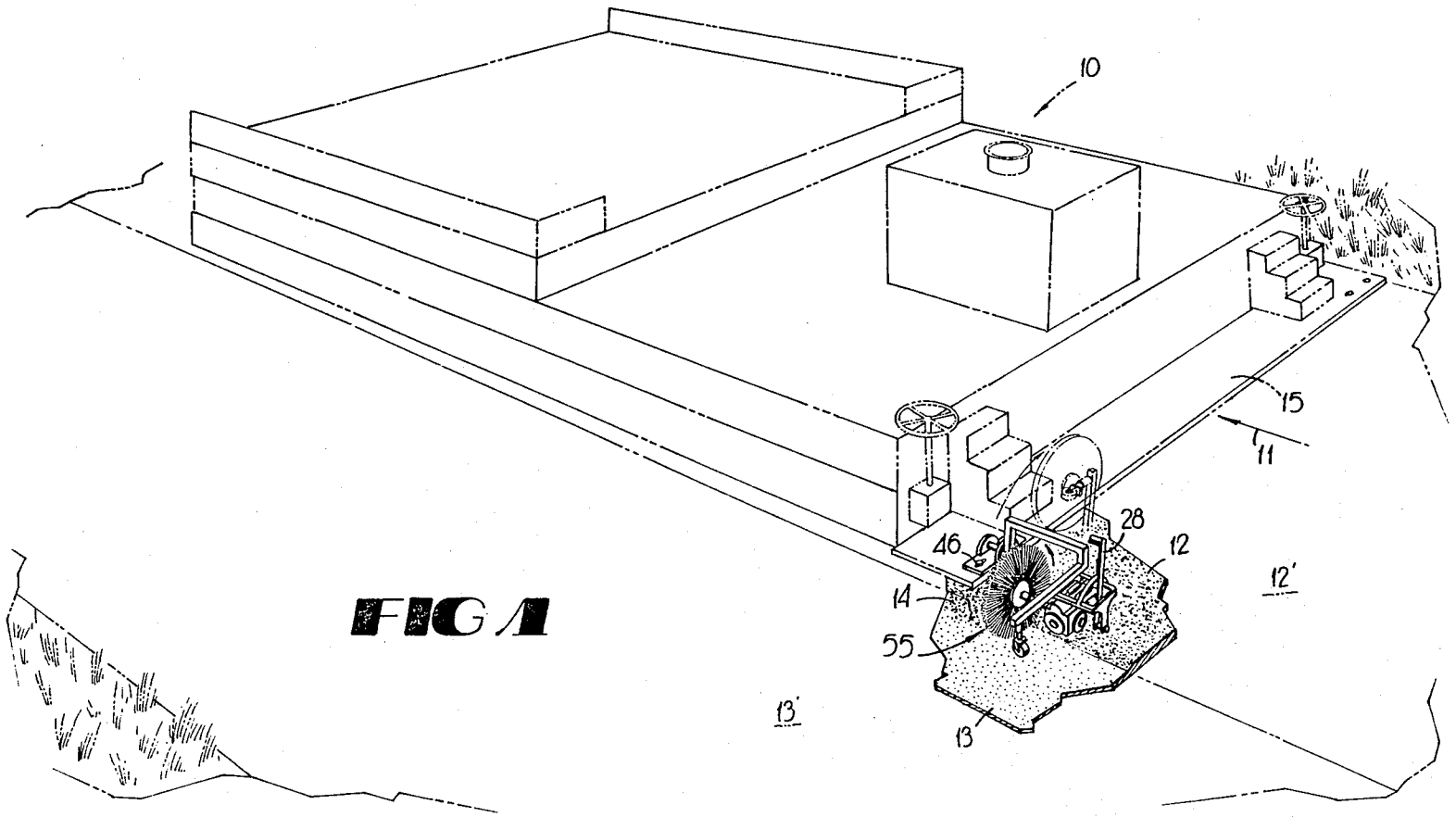
FIG. 1 is a perspective view of apparatus embodying principles of the present invention shown attached to the rear of an asphalt spreader the process of paving a lane adjacent a previously paved lane.

With reference next to the drawing, there is shown in FIG. 1 an asphalt spreader 10 of conventional construction which is moving in the direction of travel indicated by arrow 11 in spreading and applying a layer of asphalt 12 to a lane 12' of a road. Lane 12' is located adjacent to another layer of asphalt 13 previously applied to an adjacent lane 13'. As shown in this figure, the spreader 10 has just applied a strip 14 of fresh asphalt that overlaps onto the layer of asphalt 13. Heretofore, this strip of asphalt, which is applied in order to ensure surface continuity between lanes, has had to be promptly removed by manual sweeping. This task is now done automatically without the need for significant manual labor through the use of the apparatus of the present invention. This apparatus is shown in FIG. 1, attached to the running board 15 that extends laterally along the rear end of the spreader 10.

Figure 2:
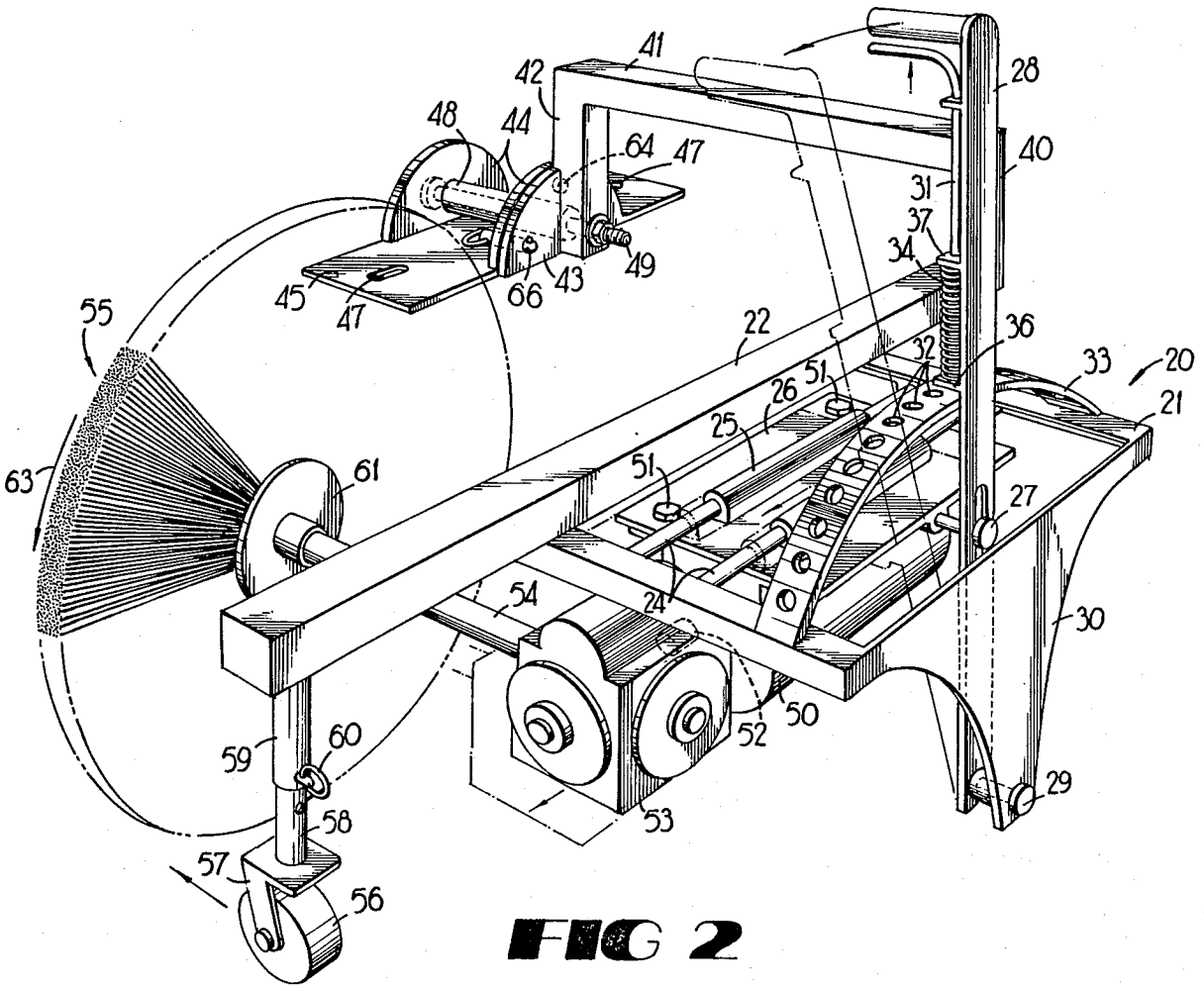
FIG. 2 is an enlarged, perspective view of the apparatus illustrated in FIG. 1.

With reference next to FIG. 2, the apparatus is seen to be comprised of a mount, shown generally at 20, which includes a mount frame 21 secured beneath a beam 22. A pair of track guide rods 24 is mounted in mutually parallel relation to the frame 21 rearwardly of the beam 22. Two collars 25 of a translation table 26 are slidably mounted upon the guide rods within the bounds of the frame 21. A bolt 27 extends through an uprightly elongated slot formed in a handle 28 into a threaded hole formed in a side of the translation table 26 thereby coupling the translation table with the handle. An elongated set rod 31 is slidably mounted beside the handle 28 for detenting engagement within a line of detent holes 32 formed in an arcuate bridge 33 that spans the frame 21. The rod is biased by a compression spring 34 downwardly whereby the position of the handle relative to the line of detent holes in the bridge may only be changed by manually lifting the set rod, as indicated by the arrow shown here. The handle 28 is mounted by a pivot pin 29 to the bottom of a leg portion 30 of the frame.

The mount 20 is further seen to include a post 40 that extends upwardly from an end of beam 22 to merge with an arm 41 that extends to another post 42 which depends downwardly to a semi-circular plate 43. The plate 43 is placed flushly against one of two other semi-circular plates 44 that project upwardly from a flat mounting plate 45. The mounting 45 plate is designed to be placed atop the running board 15 of the asphalt spreader and secured thereto by bolts 46 which, as shown in FIG. 1, pass through slots 47 in the plate. A cylindrical collar 48 is mounted between the two plates 44 through which extends an elongated pivot pin 49. The pin 49 extends through mounting holes in the plates and is held in place by bolts threaded on ends of the pin. With this construction it is seen that the arm 41, as well as the other elements of the mount 20, may be rotated about the axis of the pivot pin 49.

With continued referenced to FIG. 2, an electric motor 50 is seen to be mounted by mounting bolts 51 flush against the bottom of the translation table 26. A rotatable motor drive shaft 52 extends out of the motor housing parallel with the guide rods 24 and into a right angle gear box 53 which is mounted to one end of the motor. Another drive shaft 54 extends at a right angle to the motor shaft 50 out of the gear box beneath the beam 22 in a direction parallel to the axis of the pivot pin 49. A disc-shaped brush 55 is mounted by coupling 61 to an end of the shaft 54 for rotation in a plane oriented generally parallel with the beam 22 and transverse to the axis of the pivot pin 49.

The end of the beam 22 distal post 40 is supported upon the terrain by a roller 56 rotatably mounted to a fork 57 from which a leg 58 upwardly projects into a collar 59 mounted to the bottom of the beam. The telescopic position of the leg 58 may be adjusted within the collar by aligning holes formed therein and inserting a cotter pin 60 therethrough. In this manner the elevation of the beam 22 and of the brush 55 may be adjusted.

For operation, the apparatus is mounted to the rear of the asphalt spreader 10 by merely placing the mounting plate 45 flush upon a side of the running board 15, as shown in FIG. 1, and then securing it in place by inserting bolts 46 through slots 47 formed in the mounting plate and into tapped holes formed in the running board. The mount 20 may then be pivotably secured to the mounting plate by inserting the pivot pin 49 through aligned holes in the post 42, the plates 43 and 44, and through the collar 48. Bolts then secure the pin in place. Once this is done the mount 20 and other components secured thereto is movably supported upon the terrain adjacent the spreader by roller 56 and its pivotal mounting to the spreader.

As previously stated, the height of the mount and of the brush 55 may be adjusted by telescopically repositioning the leg 58 within the collar 59 and then reinserting the cotter pin 60. In this manner the elevation of the brush may be reset and from time to time as different brushes are used and become worn. The position of the brush laterally along the mount may also be altered. This is done by merely manually raising the set rod 31 against the bias provided by the spring 34 and then pivoting handle 28 one way or the other about pivot pin 29. This causes the translation table 26 and the motor driven brush to be moved upon the rails 24 due to the loose coupling provided by the bolt 27 which extends through the slot 21 formed in the handle. Once the desired lateral position of the brush is obtained the set rod 31 is released whereupon its end detents downwardly into one of the holes 32 formed in the frame bridge 33. As previously explained, the brush is laterally positioned upon the strip of asphalt 14 shown in FIG. 1 where excess asphalt has been applied by the spreader atop the previously paved lane 13'. The electric motor 5 may then be coupled with a source of electric power carried by the asphalt spreader by an unshown electrical cord.

As the spreader 10 is moved in the direction of travel indicated by arrow 11 it spreads asphalt down upon the the lane 12'. As this is done excess asphalt is laid as the strip 14 upon the layer of asphalt 13 of the adjacent lane 13'. As the spreader advances the apparatus of FIG. 2 is pulled along behind the spreader supported by roller 56 and the pivotably coupling engagement with the spreader plate secured to the running board 15. The motor 50 drives the brush 55 in the direction indicated by the arrow 63 whereupon the excess asphalt along strip 14 is swept onto the freshly laid layer of asphalt 12 just to the rear of the spreader. Although the direction of sweep here is at a right angle to the direction of spreading movement, it may alternatively be at an acute angle so that the sweep is directed further to the rear of the spreader by merely skewing the orientation of the mounting plate 45 upon the running board. Asphalt swept from strip 14 becomes aggregated with the asphalt 12 for subsequent rolling by an ancillary roller.

Once the paving operation is complete the electric motor may be deactivated and the entire apparatus raised to the stowed position shown in broken lines in FIG. 1 by merely lifting beam 22 and then inserting a cotter pin into a hole 64 formed within one of the pillar blocks 44 to support the lower edge of the plate 43. In the stowed position the apparatus is elevated above the terrain and located to the rear of the spreader in a protected and unobtrusive location.

It thus is seen that apparatus for redistributing asphalt spread by an asphalt spreader is provided which overcomes problems heretofore encountered in surfacing and resurfacing roadways. Though it has been described as redistributing asphalt it can, of course, be used to redistribute a variety of materials. It should, therefore, be understood that the just described apparatus merely illustrates principles of the invention in one preferred embodiment. Thus, many modifications, additions and deletions may be made thereto without departure from the spirit and scope of the invention as set forth in the following claims.

I claim:

1. Apparatus for redistributing asphalt laid by an asphalt spreader overlapping a lane adjacent the lane being surfaced by the spreader, and with the apparatus comprising a mount, motor means mounted to said mount, a brush coupled with said motor for rotatable movement, and means for securing said mount to the rear of an asphalt spreader with said brush located at a position behind the spreader for sweeping asphalt from the adjacent lane onto the lane being surfaced to the rear of the spreader.

2. The apparatus of claim 1 wherein said mount securing means includes means for securing said mount for movement between said brush sweeping position and a brush stowed position elevated above and to one side of said sweeping position.

3. The apparatus of claim 2 further comprising means for adjusting the location of said brush sweeping position relative to said mount securing means.

4. The apparatus of claim 1 further comprising a roller rotatably mounted to said mount for movement upon the adjacent lane in supporting said mount and brush.

5. Apparatus adapted to be attached adjacent the rear of an asphalt spreader for sweeping asphalt from an adjacent lane beside the spreader onto the lane being surfaced behind the spreader as the spreader moves in an operative direction, and with the apparatus comprising, in combination, a mount, a motor mounted to said mount, a brush coupled by power transmission means with said motor for rotatable movement about an axis, and means for securing said mount to the rear of an asphalt spreader with said axis oriented generally parallel with the operative direction of the spreader movement along a side of the spreader.

6. The apparatus of claim 5 wherein said power transmission means includes a right angle gear box.

7. The apparatus of claim 5 further comprising means for adjusting the location of said axis without alteration in axis orientation.

8. The apparatus of claim 5 wherein said mount is pivotably mounted coupled with said mount securing means, and wherein said apparatus further comprises roller support means for movably supporting said mount upon one of the lanes.

9. Apparatus for redistributing asphalt spread by an asphalt spreader, and with the apparatus comprising a mount adapted to be pivotably secured to the rear of an asphalt spreader for pivotable movement about a pivot axis extending generally fore and aft of the spreader, said mount having a translation table slidably supported upon a track that extends transversely to said pivot axis; a motor secured to said translation table having a motor drive shaft extending generally parallel with said track into a right angle gear box; a brush drive shaft coupled with said motor drive shaft within said gear box that extends generally parallel with said pivot axis, a brush secured to said brush drive shaft; a support roller rotatably mounted to said mount; and handle means pivotably mounted to said mount and coupled with said translation table for adjusting the position of said brush relative to said mount.

10. The apparatus of claim 9 further comprising a plate adapted to be secured to an asphalt spreader to which said mount is pivoted, and means for holding said mount to said plate in a stowed position with said support roller and brush elevated above supporting terrain.

* * * * *